US007334303B2

(12) United States Patent
Kruck

(10) Patent No.: US 7,334,303 B2
(45) Date of Patent: Feb. 26, 2008

(54) WATER-JET WEB-TREATING APPARATUS

(75) Inventor: Martin Kruck, Nussloch (DE)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 11/525,228

(22) Filed: Sep. 21, 2006

(65) Prior Publication Data

US 2007/0084030 A1 Apr. 19, 2007

(30) Foreign Application Priority Data

Sep. 22, 2005 (DE) ..... 10 2005 045 224

(51) Int. Cl.
*D04H 1/46* (2006.01)

(52) U.S. Cl. ..... 28/104

(58) Field of Classification Search ..... 28/104, 28/105, 167, 106; 492/28, 32, 53, 48–51, 492/55, 56; 162/368, 372, 373
See application file for complete search history.

(56) References Cited

U.S. PATENT DOCUMENTS 3,681,183 A * 8/1972 Kalwaites ..... 428/131
3,681,184 A * 8/1972 Kalwaites ..... 428/134
3,750,237 A * 8/1973 Kalwaites ..... 28/105
3,787,932 A * 1/1974 Kalwaites ..... 28/105
4,868,958 A 9/1989 Suzuki
5,274,893 A 1/1994 Kitamura
5,301,401 A 4/1994 Suzuki
5,414,914 A 5/1995 Suzuki
5,674,591 A 10/1997 James
6,055,710 A * 5/2000 Fleissner ..... 28/104
6,405,416 B1 * 6/2002 Fleissner ..... 28/106
2003/0088956 A1 * 5/2003 Strandqvist et al. ..... 28/104
2005/0155200 A1 * 7/2005 Fleissner ..... 28/104

FOREIGN PATENT DOCUMENTS

DE 1 001 964 4/1959

* cited by examiner

*Primary Examiner*—Amy B. Vanatta
(74) *Attorney, Agent, or Firm*—Andrew Wilford

(57) ABSTRACT

An apparatus for the water-jet treatment of a textile web has a perforated drum having an outer surface, a coarse-mesh screen overlying the outer surface, and a fine-mesh screen or tube overlying the coarse-mesh screen. This fine-mesh tube has annularly continuous filaments shrunk so as to press the coarse-mesh screen against the outer drum surface.

10 Claims, 2 Drawing Sheets

WATER-JET WEB-TREATING APPARATUS

FIELD OF THE INVENTION

The present invention relates to an apparatus for treating a textile web with water jets. More particularly this invention concerns such an apparatus used to compact and/or structure the web, which can be a felt, mat, weave, or knit of natural, synthetic, or endless fibers or mixtures thereof.

BACKGROUND OF THE INVENTION

An apparatus is known from US 2005/0155200 of G. Fleissner for producing three-dimensional colorless patterns for a material web by means of water needling. An apparatus for manufacturing perforated nonwoven fabric materials using water jets or hot air impinged on by high pressure is also described in U.S. Pat. No. 5,274,893 of Kitamura. U.S. Pat. Nos. 4,868,958, 5,301,401, and 5,414,914 of Suzuki, and DE 1 001 964 also describe apparatuses that provide a prefabricated nonwoven fabric with a perforated texture. The pressure-impacted water jets impart a perforated texture to the nonwoven web that is supported on a strip provided with plastic projections or on a drum provided with plastic projections. Furthermore, materials are known from U.S. Pat. No. 5,674,591 of James that have relief-like textures as well as perforations in a precisely specified configuration.

OBJECTS OF THE INVENTION

It is therefore an object of the present invention to provide an improved apparatus for the water-jet treatment of a textile web.

Another object is the provision of such an improved apparatus for the water-jet treatment of a textile web that overcomes the above-given disadvantages, in particular that can be used to compact and/or structure a web and that is of simple construction having a long service life.

The invention also relates to a method of making a drum for a water-jet web-treatment apparatus according to the invention.

SUMMARY OF THE INVENTION

An apparatus for the water-jet treatment of a textile web according to the invention has a perforated drum having an outer surface, a coarse-mesh screen overlying the outer surface, and a fine-mesh screen or tube overlying the coarse-mesh screen. This fine-mesh tube has annularly continuous filaments shrunk so as to press the coarse-mesh screen against the outer drum surface.

The object of the invention is thus attained by a fine-mesh screen that is a continuous tube that is shrunk onto a perforated drum. By use of a shrink screen, two totally different functions of the apparatus according to the invention may be fulfilled, namely, texturing of the material web and compacting same.

BRIEF DESCRIPTION OF THE DRAWING

The above and other objects, features, and advantages will become more readily apparent from the following description, reference being made to the accompanying drawing in which.

SPECIFIC DESCRIPTION

As seen in FIG. a web W, which can be a nonwoven or woven fabric made of synthetic fibers, natural fibers, continuous fibers, or mixtures of such fibers, is advanced in a direction D by a pair of feed rollers 5 toward a cylindrical drum 1 centered on an axis A. The web W passes over the drum 1 and is subjected to high-pressure jets from nozzle beams 6 that compact and/or structure it. Thence the web W passes off over an aspirating slot of a device 7 that suck water out of it.

Figure 1:
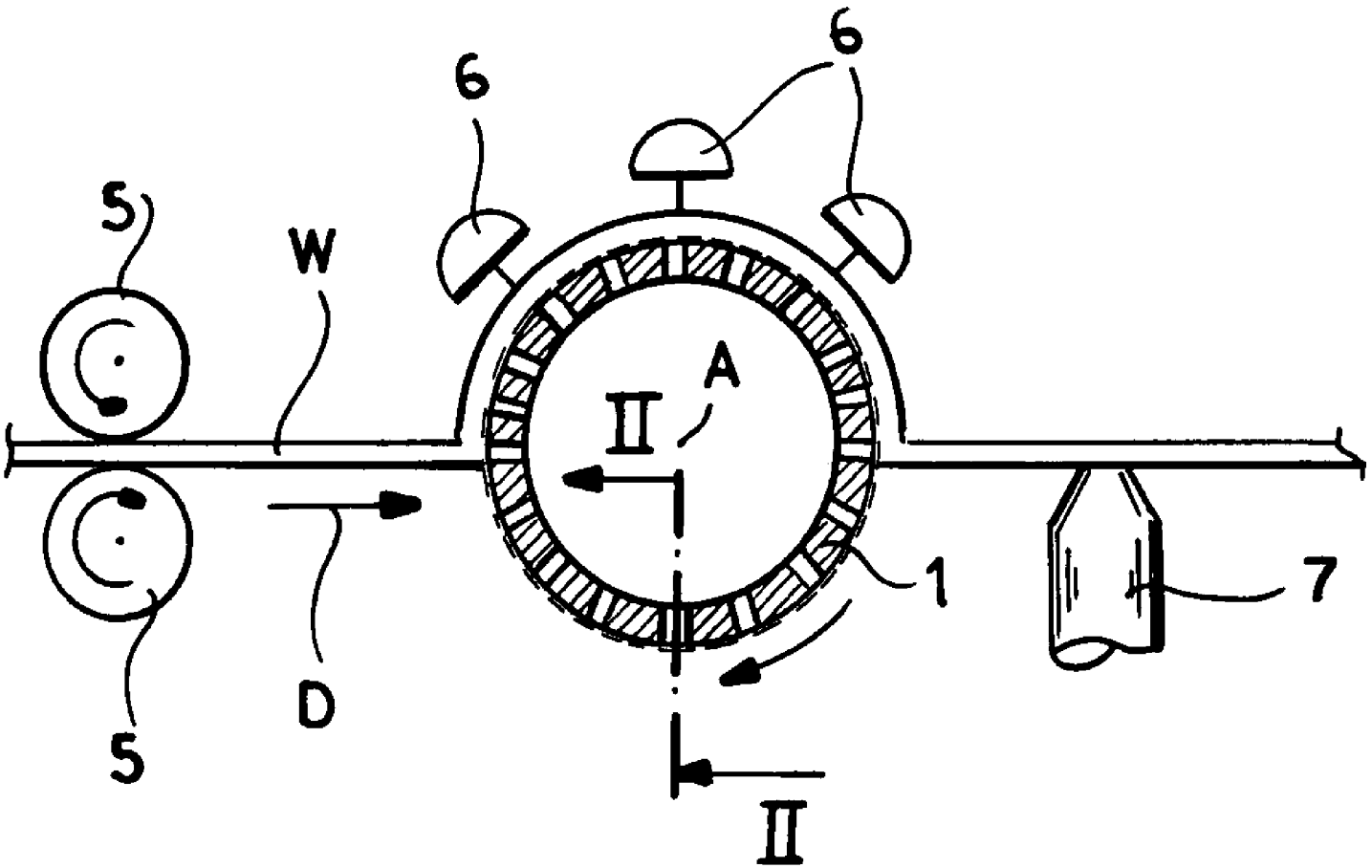
FIG. 1 is a small-scale diagrammatic view of the apparatus according to the invention.
Figure 2:
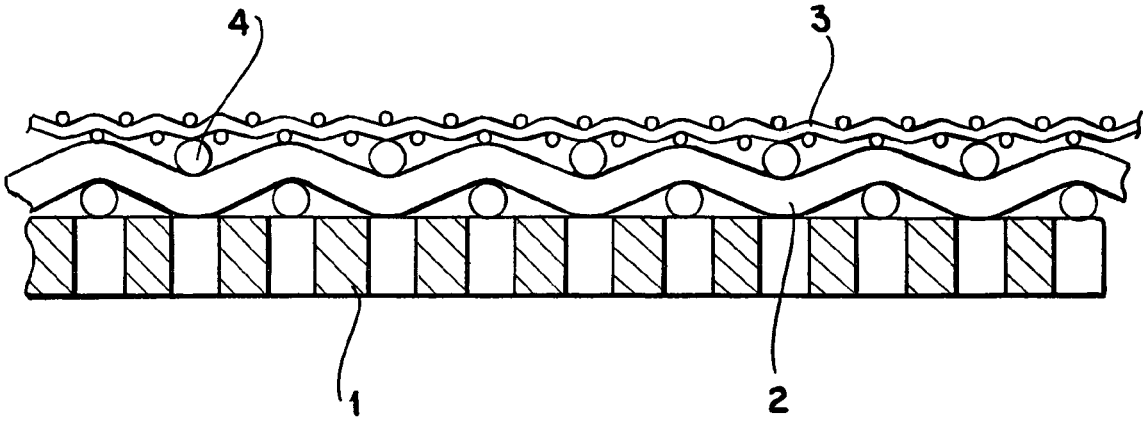
FIG. 2 is a large-scale section taken along line II-II of FIG. 1.

As shown in FIG. 2, a cylindrical outer surface of the perforated drum 1 is covered by a coarse-mesh inner screen 2 and a fine-mesh outer shrink screen 3 thereover. The shrink screen 3 is composed of a screen strip that is shrunk as a continuous tube.

When this apparatus is employed for texturing, coarse-mesh shrink screens 3 are used having approximately 5 wires/cm (warp and weft). A previously compacted nonwoven fabric web having a textile texture is treated with its texturing running in the feed direction and at right angles thereto. This is achieved by means of a coarse shrink screen whose shrinkable warp threads run angularly around the drum 1 so as to lie in planes perpendicular to the axis A, and whose non-shrinking weft threads extend parallel to the axis A of the drum 1. In the texturing carried out in this manner, even heavy materials with a basis weight greater than 100 $g/m^2$ may be processed, because a rebound effect does not occur with the water jets used in the needling and also is not necessary, since heavy nonwoven fabrics represent a barrier for the energy-intensive water jets and thus prevent shooting through. Compaction of the material web is not achieved in the texturing carried out in this manner, so it is necessary for the nonwoven fabric to have acquired its strength beforehand.

Usually, the shrink screen used for texturing is inserted as the furthest downstream strip in the system, since after texturing no further needling stages may be used. Any further needling would destroy the texture produced. In this procedure the final suction slit 7 is provided to dewater the wet nonwoven fabric web W in order to convey the material with a defined residual moisture to the subsequent drying process or other subsequent processes.

Another possible application for the apparatus according to the invention consists in also using the shrink screen applied to the perforated drum as a substitute for the microporous shell heretofore employed for compacting a light nonwoven fabric, that is of a basis weight less than 100 $g/m^2$.

The prior-art use of a microporous shell has disadvantages. When such a microporous shell is used, the perforated drum must be fabricated to very tight tolerances, since the microporous shell must be pushed onto the drum with little play so as not to be damaged by increased fulling during operation. If the microporous shell were replaced by a shrink. screen, for example, the perforated support drum could be fabricated to looser tolerances, since a shrink screen is better able to compensate for diameter differences in the drum. As a result, a shrink screen requires much lower capital costs compared to a microporous shell, and a damaged or worn shrink screen may be replaced relatively easily, whereas a new microporous shell is delivered with a different diameter on account of the tolerances, and it is very likely that it cannot be adapted to the drum as well as the previously used microporous shell.

However, if according to the invention a shrink screen 3 is used having wires with diameters of 0.15 to 0.2 mm and 25 to 45 wires/cm (warp and weft) longitudinal and transverse to the feed direction, excellent compaction effects are obtained. For light nonwoven fabrics there is the risk that the energy-intensive water jets that impinge on the nonwoven fabric at a velocity of greater than 200 km/h, simply shoot through the fabric. The kinetic energy of the water jet is thus ineffectual and is lost. This would reduce the efficiency of the machine and significantly increase the energy used per kilogram of finished material.

According to the invention, however, use is made of the kinetic energy of the water jets to modify the position of the individual fibers, thereby increasing the strength of the previously loose fiber assembly. For light nonwoven fabrics, this is achieved according to the invention by the fact that a very fine shrink screen is shrunk onto the drum 3, and as a result of the fine texture a homogeneous surface is obtained from which the water jet rebounds. The water jets impinging at high velocity on the nonwoven fabric pass through the fabric and then impact the shrink screen 3, and from there rebound against the nonwoven fabric. The resulting rebound effect causes the nonwoven fabric to be needled on the underside as well, resulting in significantly higher strength caused by better entangling of its fibers.

Of course, a material web compacted in this manner may be subsequently conveyed to a texturing step, as described in detail above.

In the screen strips used in the apparatus according to the invention, open areas are provided for diverting the liquid that is sprayed under high pressure from the numerous exit openings of a nozzle beam. The shrinkable screen strips contain warp and weft threads that may be composed of thermoplastic homo- or copolymers. However, it is particularly advantageous for the shrinkable screen strip to contain weft threads composed of metal wire.

Figure 3:
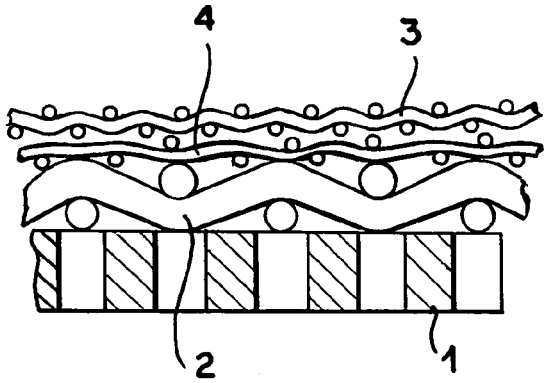
FIG. 3 is a view like FIG. 2 of a variant on the apparatus of this invention.

Furthermore as shown in FIG. 3, in special cases an apparatus may be very advantageous in which an additional screen 4 is inserted between the coarse-mesh inner screen 2 and the shrink screen 3, so that a total of three screens lie one on top of the other on the perforated drum 1. This is particularly advisable when there are large differences in the mesh size and/or the wire thickness between the inner screen and the shrink screen.

By use of the apparatus according to the invention it is possible to manufacture, for example, a nonwoven fabric of 57 g/m$^2$that has the following characteristic data for a composition of 70:30 viscose/polyester and a production speed of 70 m/min:

When the shrink screen according to the invention is used, a strength of 93 N in the machine direction and a strength of 20 N in the transverse direction are obtained for a nonwoven fabric thickness of 0.72 mm. If such a material web is manufactured using the conventional microporous shell, a strength of 95 N in the machine direction and 20 N in the transverse direction are observed for a nonwoven fabric thickness of 0.73 mm.

I claim:

1. In an apparatus for the water-jet treatment of a textile web, a perforated drum having an outer surface;

a coarse-mesh screen overlying the outer surface; and a fine-mesh tube overlying the coarse-mesh screen and having annularly continuous filaments shrunk so as to press the coarse-mesh screen against the outer drum surface.

2. The water-jet web-treatment apparatus defined in claim 1 wherein the outer surface, screen, and tube are all generally cylindrical and coaxial.

3. The water-jet web-treatment apparatus defined in claim 2 wherein the tube has warp and weft filaments spaced at about 0.2 cm.

4. The water-jet web-treatment apparatus defined in claim 2 wherein the shrunk continuous filaments are warp filaments and the screen has weft filaments extending generally axially of the drum.

5. The water-jet web-treatment apparatus defined in claim 1 wherein the drum forms the last treatment stage of a web-structuring system.

6. The water-jet web-treatment apparatus defined in claim 1 wherein the fine-mesh tube is a weave of warp and weft filaments having a diameter between 0.15 mm and 0.2 mm and a spacing of 25 to 45 filaments/cm.

7. The water-jet web-treatment apparatus defined in claim 1, further comprising:

a nozzle beam directing a plurality of high-pressure jets of water at the drum, the web being treated passing over the drum, in engagement with the fine-mesh tube, and between the beam and the drum.

8. The water-jet web-treatment apparatus defined in claim 1 wherein the fine-mesh tube has filaments of a thermoplastic homo- or copolymer.

9. The water-jet web-treatment apparatus defined in claim 1 wherein the fine-mesh tube has warp filaments that are the annularly continuous filaments and also has metallic weft filaments.

10. The water-jet web-treatment apparatus defined in claim 1, further comprising another screen between the fine-mesh tube and the coarse-mesh screen.

* * * * *